US006364033B1

(12) United States Patent
Hung et al.

(10) Patent No.: US 6,364,033 B1
(45) Date of Patent: Apr. 2, 2002

(54) PORTABLE ELECTRIC TOOL

(75) Inventors: Lam Chin Hung, Ravana Garden; Mok Kwok Ting, Cityone Shatin, both of (HK)

(73) Assignee: Techtronic Industries Co. Ltd., Hong Kong (CN)

( * ) Notice: Subject to any disclaimer, the term of this patent is extended or adjusted under 35 U.S.C. 154(b) by 0 days.

(21) Appl. No.: 09/940,170

(22) Filed: Aug. 27, 2001

(51) Int. Cl.[7] ..... B25B 23/00

(52) U.S. Cl. ..... 173/217; 173/170; 173/216; 310/50

(58) Field of Search ..... 173/216, 217, 173/170, 42, 29, 45; 310/50, 47; 81/177.8, 177.85, 180.1

(56) References Cited

U.S. PATENT DOCUMENTS

| | | | | |
|---|---|---|---|---|
| 4,522,270 A | | 6/1985 | Kishi | |
| 4,759,240 A | | 7/1988 | Lin | |
| 4,770,559 A | | 9/1988 | Yoo | |
| D304,419 S | | 11/1989 | Henck et al. | |
| 4,912,349 A | | 3/1990 | Chang | |
| 4,962,681 A | | 10/1990 | Yang | |
| 4,976,173 A | | 12/1990 | Yang | |
| 5,533,581 A | * | 7/1996 | Barth et al. | 173/217 |
| 5,694,818 A | | 12/1997 | Nickipuck | |
| D418,729 S | | 1/2000 | Snider | |
| 6,039,126 A | * | 3/2000 | Hsieh | 173/170 |
| 6,053,076 A | | 4/2000 | Barnes | |
| 6,102,134 A | * | 8/2000 | Alsruhe | 173/217 |

* cited by examiner

*Primary Examiner*—Scott A. Smith
(74) *Attorney, Agent, or Firm*—Brooks & Kushman P.C.

(57) ABSTRACT

A portable electric tool having an elongate housing including a first housing member and a second housing member pivotally connected to the first housing member about a pivot axis along a common mating plane. A channel formed adjacent a proximal end of the first housing member cooperates with one of a plurality of apertures formed through a proximal end of the second housing member to form a passage therebetween. A locking mechanism for adjustably positioning the second housing member relative to the first housing member about the pivot axis includes a spring disposed within the passage, a pin biased against the spring shiftable between a locked position and an unlocked position relative to a common mating plane and a locking member adapted to shift the pin between the locked and unlocked positions.

19 Claims, 5 Drawing Sheets

PORTABLE ELECTRIC TOOL

TECHNICAL FIELD

The present invention relates to a portable electric tool having a locking mechanism for adjustably positioning opposing housing sections of the screwdriver.

BACKGROUND ART

Portable electric tools, including portable electric screwdrivers, are produced in a variety of different types and configurations. Portable electric screwdrivers commonly comprise a single tubular housing having a chuck assembly mounted at one end and a handle portion at the opposite end. An electric motor is provided in the housing to rotatably drive the chuck assembly. One or more batteries disposed in the handle portion supply power to the motor. This single housing arrangement is capable of performing a variety of tasks, but has limited usefulness in work areas with restricted space.

An alternative arrangement for a portable electric screwdriver is to provide an elongate housing having multiple sections interconnected at a pivot joint. A hingedly connected two-part housing is generally shiftable between an inline stick configuration and a L-shaped configuration to accomplish a variety of tasks in a confined work area. Current pivoting arrangements for screwdrivers use complex structural designs to interconnect the multiple sections of the housing. These various assemblies comprise a multiple section housing interconnected by a fastener at an adjustable joint and a retractable cover which telescopes internally of the housing. The retractable cover is pivotally connected to a separate portion of the housing to limit inadvertent rotation of the housing portions. This adjustable joint assembly, which requires specifically toleranced parts, are problematic because the molded parts may bind during assembly, restricting the rotation of the joint assembly.

It is the goal of the present invention to provide a portable electric screwdriver having a simple, low cost locking mechanism for selectively positioning multiple sections of an elongate housing. Further, it is the goal of the present invention to provide a portable electric screwdriver having a adjustable joint system using a locking mechanism which is strong, reliable and simple to operate.

DISCLOSURE OF INVENTION

Accordingly, a portable electric tool is disclosed comprising an elongate housing having a first housing member and a second housing member pivotally connected about a pivot axis to the first housing member along a common mating plane. A channel spaced apart from the pivot axis is formed adjacent a proximal end of the first housing member and is alignable with one of a plurality of apertures formed through a proximal end of the second housing member to form a passage therebetween. Each of the plurality of apertures corresponds to a locking position for the first housing member relative to the second housing member.

A power source is disposed within an inner periphery of the second housing member of the portable electric tool housing. A drive motor is mounted to the inner periphery of the first housing member and is electrically connected to the power source. A chuck assembly adapted to receive a tool bit is mounted to the distal end of the first housing member adjacent the drive motor. The chuck assembly is operatively connected to and rotatably driven by the drive motor. A switch disposed on the outer periphery of the second housing member activates the motor.

A locking mechanism for adjustably positioning the first housing member relative to the second housing member between a first position and at least one second position is provided adjacent the pivot axis of the housing. The locking mechanism includes a spring disposed within the channel in the first housing member, a pin biased against the spring shiftable between a locked position and an unlocked position and a locking member disposed on the second housing member. The pin is biased upward in the passage by the spring to extend through the common mating plane and passage to lock the first housing member of the tool relative to the second housing member. At least one projection extends from the locking member into the plurality of apertures to selectively position the pin in the passage between the first and second housing members relative to the common mating plane.

The locking mechanism is selectively positionable to allow the first housing member of the portable electric tool to rotate relative to the second housing member between a first position and at least one second position. The at least one projection of the locking member engages an upper end of pin to position the upper end of the pin between the locked position and the unlocked position. In the locked position, the spring biases pin through the common mating plane into position between one of the plurality of apertures and the channel to secure the first housing member relative to the second housing member. In the unlocked position, the locking member engages the upper end of the pin, translating the pin downward in the passage against the spring. The first housing member is freely rotatable about the pivot axis when the upper end of the pin extends below the common mating plane such that the pin cooperates only with the channel in the first housing member.

BEST MODE FOR CARRYING OUT THE INVENTION

Figure 1:
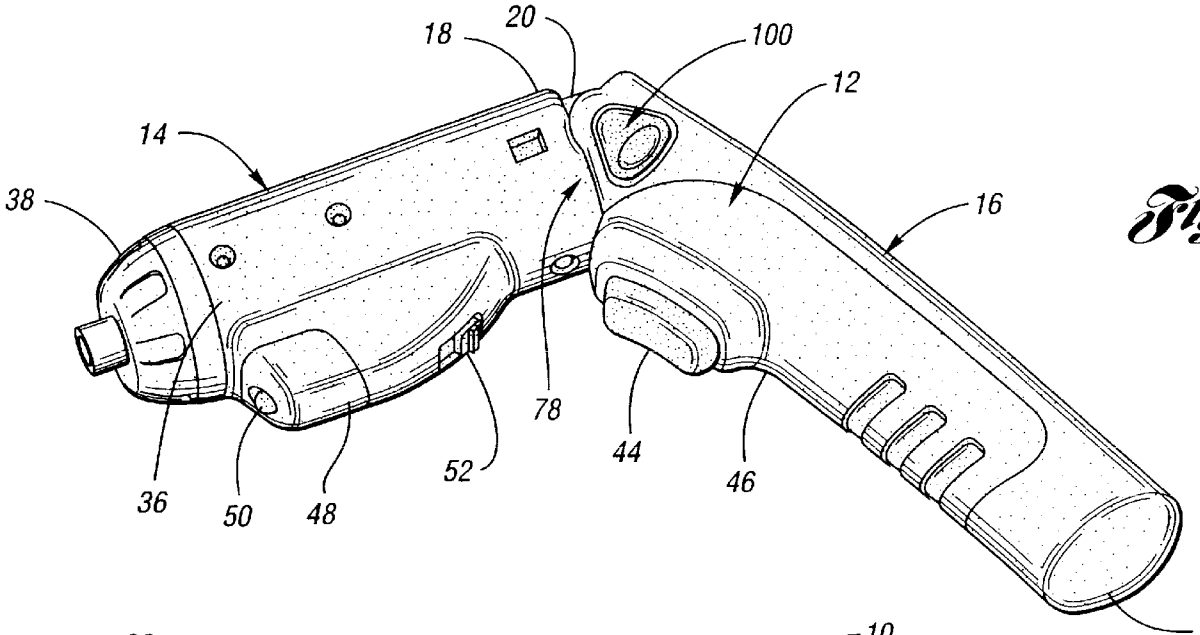
FIG. 1 is a perspective view of the portable electric tool of the present invention in the aligned position.

Portable electric tool or screwdriver 10 shown in FIGS. 1–7 illustrates a preferred embodiment of the present invention. Referring now to the Figures, a portable electric screwdriver 10 comprises an elongate housing 12 having a first housing member 14 and a second housing member 16. In a preferred embodiment of the invention, first housing member 14 comprises a drive section and second housing member 16 comprises a handle section of the elongate housing 12 which are generally tubular in shape. The proximal end 18 of the first housing member 14 is pivotally connected to a proximal end 20 of the second housing member 16 at a common mating plane 22 to facilitate the adjustable positioning or rotation of the first housing member 14 relative to second housing member 16 about a common pivot axis 24. The common mating plane 22 extends generally perpendicular to the pivot axis 24 of housing 12.

Figure 2:
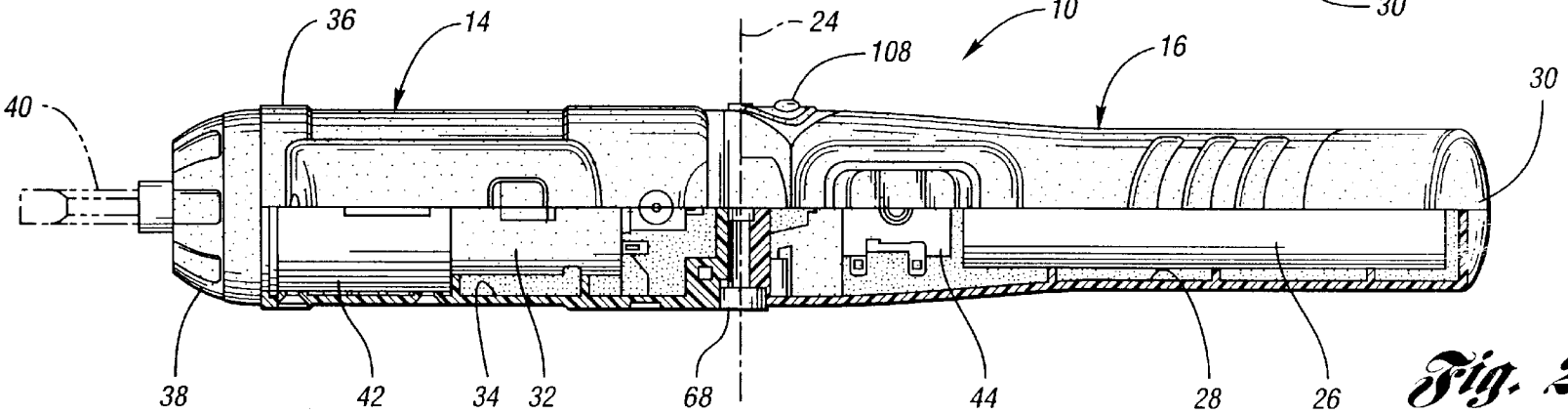
FIG. 2 is a partial schematic view of the portable electric tool of the present invention.

Referring to FIG. 2, screwdriver 10 includes a power source 26 disposed within the inner periphery 28 of elongate housing 12. In one embodiment of invention, power source 26 comprises one or more permanent batteries mounted to the inner periphery 28 of the second housing member 16. Alternatively, power source 26 may be one or more rechargeable batteries inserted into the inner periphery 28 of second housing member 16 through the distal end 30 of the second housing member 16. It is also understood that power source 26 may comprise a corded power supply (not shown) connected to the distal end 30 of second housing member 16.

A drive motor 32 is electrically connected to power source 26 by wires (not shown). Drive motor 32 is preferably mounted to the inner periphery 34 of first housing member 14 adjacent the distal end 36 to balance the weight distribution of the internal components mounted in the elongate housing 12 between the first housing member 14 and second housing member 16. A chuck assembly 38 is provided on the distal end 36 of first housing member 14. Chuck assembly 38 is adapted to receive and secure a tool bit, shown in phantom as reference numeral 40. Chuck assembly 38 is operatively connected to and rotatably driven by the drive motor 32 through shaft 42. A switch 44 provided on the outer periphery 46 of housing 12 is connected to drive motor 32 by wires.

In one embodiment of the invention, a light assembly 48 is disposed adjacent the distal end 36 of the first housing member 14 proximate the chuck assembly 38 to illuminate a work area. Light assembly 48 includes a bulb 50, such as a light emitting diode (LED) or incandescent bulb, extending through an opening in the outer periphery of first housing member 14. In one embodiment of the invention, a switch 52 extending through the outer periphery 46 is operatively coupled to the bulb 50 to activate the bulb. Alternatively, bulb 50 may be operatively coupled to switch 44 such that the bulb 50 is activated when the switch 44 activates the drive motor 32.

Figure 3:
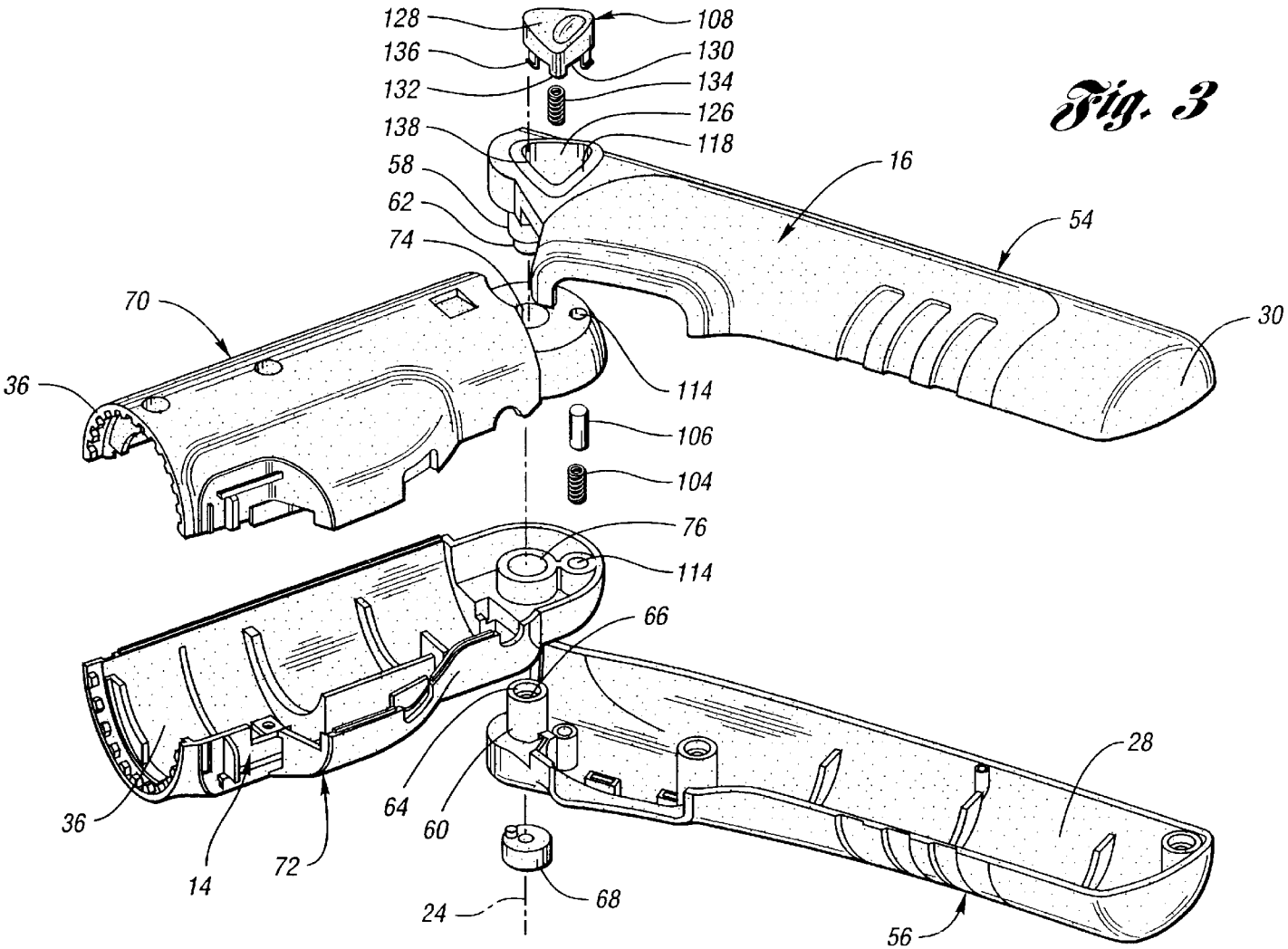
FIG. 3 is an exploded perspective view of the portable electric tool of the present invention.

Referring now to FIG. 3, second housing member 16 of elongated housing 12 of portable electric screwdriver or tool 10 is formed of a pair of opposed walls 54, 56. A pair of posts 58, 60 are integrally formed on the inner periphery 28 of opposed walls 54, 56 adjacent the proximal end 20 of second housing member 16. Post 58 includes a male extension 62 which engages a female receiving area 64 on post 60. Male extension 62 and female receiving area 64 provide a temporary interlock between posts 58, 60. A channel 66 extending through posts 58, 60 receives a fastener (not shown) to secure the opposed walls 54, 56 of the second housing member 16 together. A cap 68 may also be provided on the outer periphery 46 of second housing member 16 to receive the fastener.

First housing member 14 of elongated housing 12 is comprised of a pair of opposed walls 70, 72. A pair of holes 74, 76 are formed in each opposed wall 70, 72 adjacent the proximal end 18 of first housing member 14. Holes 74, 76 are aligned on each wall to receive posts 58, 60 extending from the proximal end 20 of second housing member 16. Upon assembly of the housing 12, posts 58, 60 from second housing member 16 extend through holes 74, 76 provided in first housing member 14 combine to form a pivot joint 78. In a preferred embodiment, the pivot joint arrangement 78 allows first housing member 14 to rotate about pivot axis 24 relative to the second housing member 16 about common mating plane 22 between a first position aligned with the second housing member 16 and at least one second position angled relative to the second housing member 16. It is understood that the first housing member 14 can be adjustably positioned to a variety of positions between 0 and 90 degrees relative to the second housing member 16.

Figure 4:
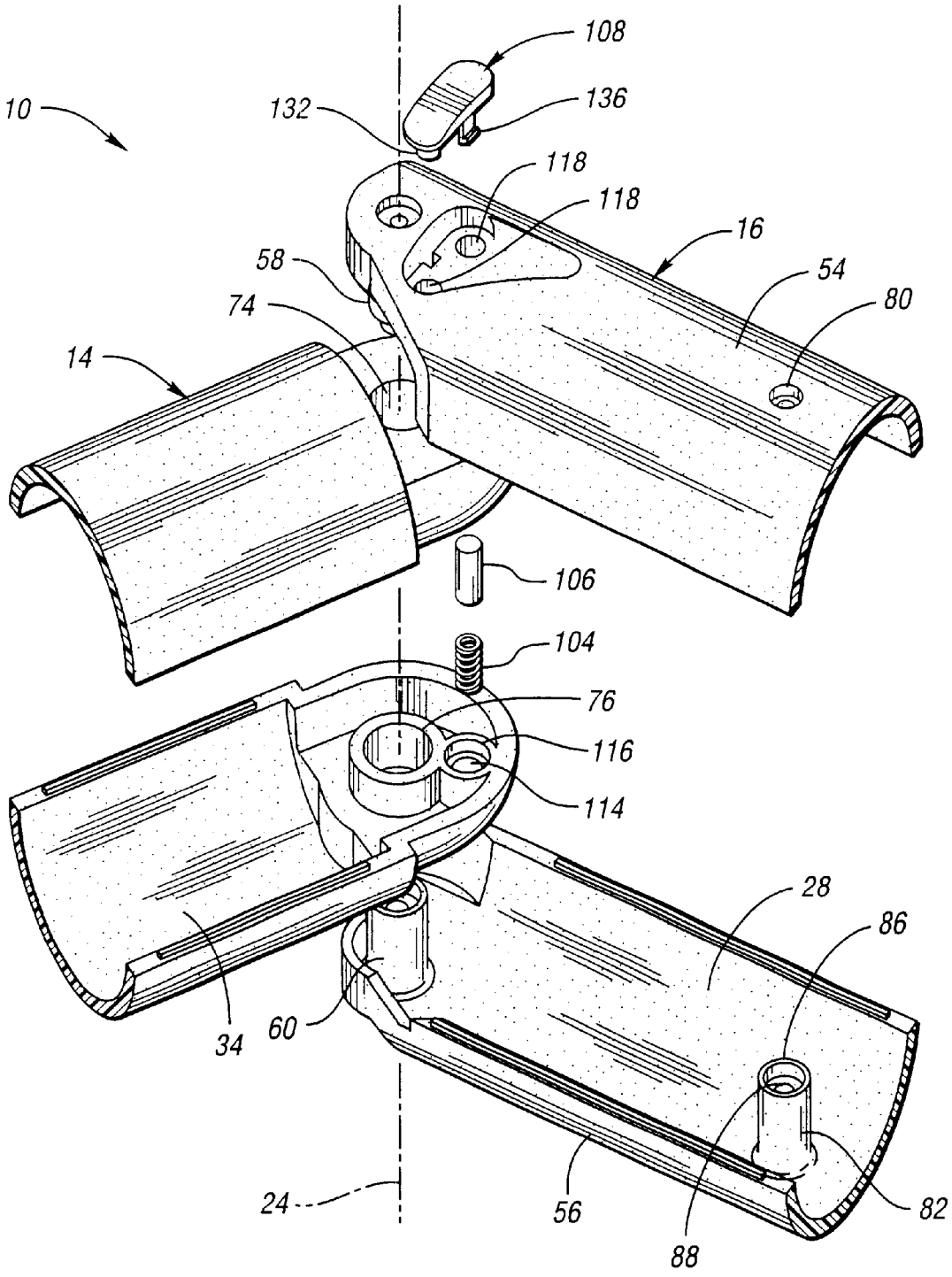
FIG. 4 is an exploded perspective view of a second embodiment of the present invention.

Referring now to FIG. 4, a second embodiment of portable electric tool 10 is disclosed. Housing 12 further includes posts extending between the inner periphery of the opposed walls of the first and second housing members 14, 16 for structural support. Posts 80, 82 are integrally formed on the inner periphery 26 of walls 54, 56 adjacent distal end 30 of second housing member 16 to provide additional structural support for the second housing member 16. Post 80 extends from wall 54 and includes a male extension 84 which engages female receiving area 86 on post 82 on wall 56. Male extension 84 and female receiving area 86 provide a temporary interlock between posts 80, 82. Channel 88 extending through posts 80, 82 receives fasteners (not shown) to secure the opposed walls 54, 56 of the second housing member 16 together.

Referring additionally to FIGS. 5–8, a preferred embodiment of locking mechanism, generally referenced by numeral 100, is provided on the portable electric tool 10 adjacent the pivot joint 78. Locking mechanism 100 cooperates with pivot joint 78 to adjustably position and secure first housing member 14 of elongate housing 12 relative to the second housing member 16 between a first position aligned with longitudinal axis 102 and at least one second position wherein first housing member 14 is angularly offset relative to the longitudinal axis 102. Locking mechanism 100 comprises three basic components: a spring 104, a pin 106 and a locking member 108. Spring 104 comprises a lower end 110 and an upper end 112. A channel 114 is formed in the first housing member 14 adjacent the pivot axis 24 by a pair of corresponding holes formed in each of the pair of opposed walls 70, 72. The lower end 110 of spring 104 is mounted in a receiving area 116 of channel 114.

A plurality of apertures 118 are provided in the outer periphery of the second housing member 16. Apertures 118 extend through the second housing member 16 adjacent the proximal end 20. Apertures 118 are spaced apart from one another at varying intervals to secure the first housing member 14 between at a first mounting position aligned with longitudinal axis 102 and at least one second mounting position angularly offset from the longitudinal axis 102. Apertures 118 are aligned with channel 114 in first housing member 14 when first housing member 14 is rotated relative to second housing member 16 about pivot joint 78 to create a passage 120.

Figure 7:
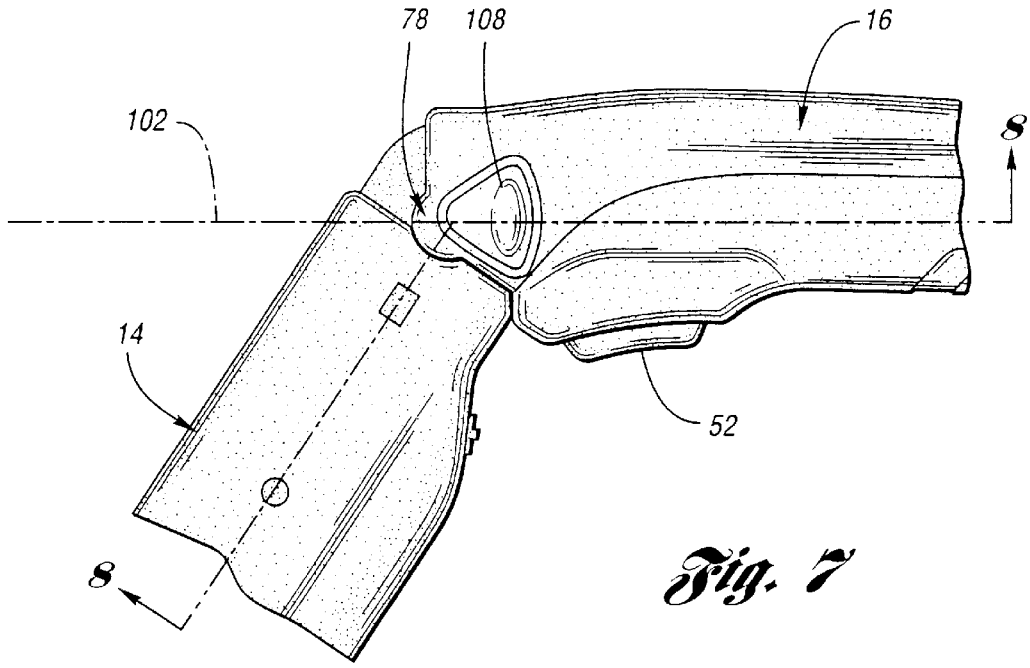
FIG. 7 is a partial perspective view of the portable electric tool of the present invention in the pivoted position.
Figure 8:
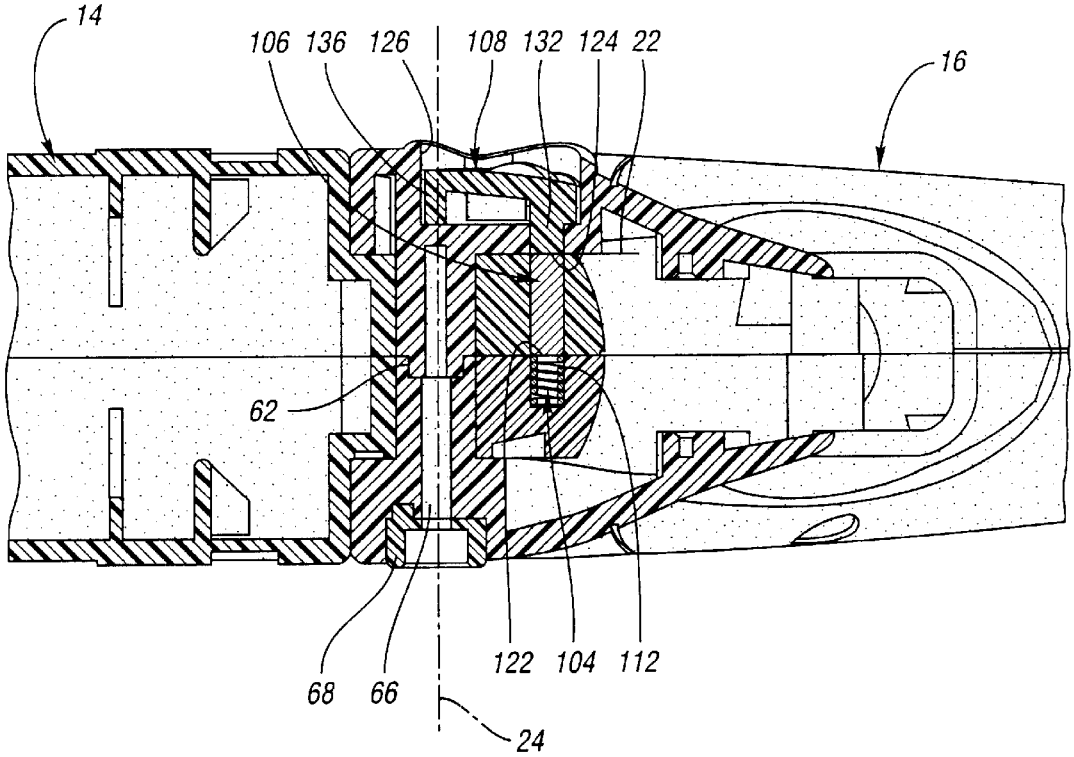
FIG. 8 is a cross-sectional side elevational view of the portable electric tool of the present invention in the pivoted position.

Pin 106 extends through passage 120 in housing 12. Pin 106 includes a lower end 122 which is biased against the upper end 112 of spring 104 and an upper end 124. The pin 106 is shiftable in the passage 120 between a locked position, generally illustrated in FIGS. 5 and 6, and an unlocked position, as is illustrated in FIGS. 7 and 8. Pin 106 extends through common mating plane 22 in passage 120 through both the channel 114 in first housing member 14 and one of apertures 118 in second housing member, locking the first housing member 14 in position relative to second housing member 16. A further description of the operation of locking mechanism 100 in the selective positioning of first housing member 14 relative to the second housing member 16 of the elongate housing 12 is described in greater detail below.

Locking member 108 of locking mechanism 100 is provided on the outer periphery 46 of second housing member 16. In a preferred embodiment of the invention, a cavity 126 is formed above apertures 118 in the outer periphery 46 of second housing member 16 adjacent pivot joint 84 to receive locking member 108. Locking member 108 includes an upper surface 128 and a lower surface 130 having at least one projection 132 extending therefrom. The at least one projection 132 extends through the plurality of apertures 118 in the first housing member 14 to engage the upper end of pin 106. In an alternative embodiment of the invention, a spring 134 is provided between locking member 108 and cavity 126 in second housing member 16. Additionally, fingers 136 may extend from the lower surface 130 of the locking member 108 to engage the second housing member 16 through holes 138 to retain the locking member 108 on housing 16.

Referring now to FIGS. 5–8, a description of positioning of the first housing member 14 relative to the second housing member 16 of the portable electric tool 10 is discussed in greater detail. First housing member 14 and second housing member 16 cooperate about common mating plane 22 to rotate relative to one another about pivot axis 74 at pivot joint 78. Pin 106 of locking mechanism 100 is adjustable between a locked position and an unlocked position in passage 120 of housing 12 to permit first housing member 14 to rotate about pivot axis 24 relative to the second housing member 16.

Figure 5:
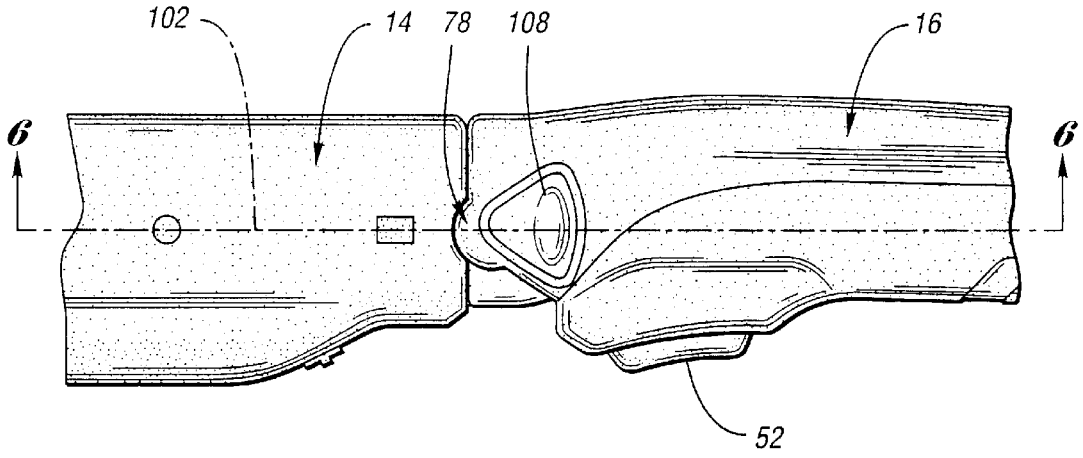
FIG. 5 is a partial perspective view of the portable electric tool in of the present invention in the aligned position.
Figure 6:
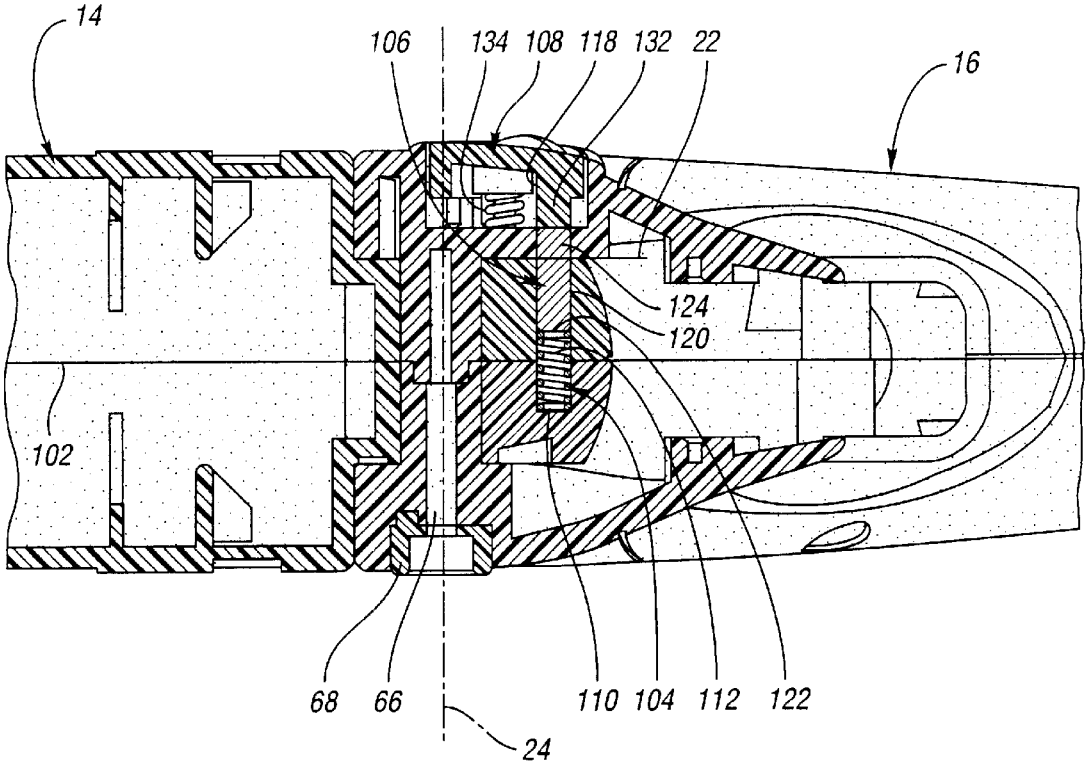
FIG. 6 is a cross-sectional side elevational view of the portable electric tool of the present invention in the aligned position.

As is shown in FIGS. 5 and 6, first housing member 14 and second housing member 16 are positioned in an inline configuration along common longitudinal axis 102. Locking mechanism 100 is shown in the locked position in FIG. 6. In the locked position, spring 104 biases the lower end 122 of pin 106 upward in passage 120, extending the upper end 124 of pin 106 through the mating plane 22 between the first and second housing members 14, 16 into one of the apertures 118. The upper end 124 of pin 106 abuts the lower end of the locking member projection 132 in aperture 118. The placement of pin 106 between channel 114 and aperture 118 of passage 120 prohibits the rotation of first housing member 14 relative to second housing member 16.

As is shown in FIGS. 7 and 8, locking mechanism 100 is moved from a locked position to an unlocked position to rotate first housing member 14 about pivot axis 24 from a first position to a second position relative to second housing member 16. In the unlocked position shown in FIG. 8, locking member 108 is depressed against second housing member 14, positioning the lower surface 130 of locking member 108 against cavity 126 on the outer periphery 46 of second housing member 16. The downward movement of locking member 108 causes locking member projection 132 to engage the upper end 124 of pin 106, translating the pin downward in passage 120. As the pin 106 is translated downward, the lower end 122 of pin 106 compresses the spring 104 in passage 120.

Once the upper end of pin 124 extends below mating plane 22, pin 106 extends only through channel 114 in first housing member 14. First housing member 14 is then freely rotatable between the first position and the at least one second position relative to the second housing member 16. When the first housing member 14 is positioned adjacent aperture 118 corresponding to the second operative position, an operator releases locking member 108, allowing spring 104 to bias pin 106 in passage 120 created by channel 114 and aperture 118 through mating plane 22 into aperture 118. The first housing member 14 is then secured relative to the second housing member 14 when the upper end 124 of pin 106 extends into aperture 118.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A locking mechanism for adjustably positioning opposing housing members of a portable electric tool which are pivotally connected to one another along a pivot axis, the locking mechanism comprising:

a first housing member including a channel formed adjacent a proximal end, the channel being spaced apart from the pivot axis;

a second housing member pivotally connected to the first housing member rotatably adjustable about the pivot axis between a first position and at least one second position, the first and second housing cooperating along a common plane perpendicular to the pivot axis, wherein the second housing member includes a plurality of apertures formed through a proximal end alignable with the channel in the first housing member to form a passage therebetween;

a spring disposed within the channel of the first housing member;

a pin biased against the spring shiftable in the passage between a locked position and an unlocked position; and a locking member disposed adjacent the plurality of apertures in the second housing member, the locking member including at least one projection extending through one of the plurality of apertures to selectively position the pin in the passage relative to the common plane, wherein the locking member engages an upper end of pin to position the pin between the locked position wherein the pin extends through this common plane and cooperates with both the channel and aperture to lock the first housing member relative to the second housing member and the unlocked position wherein the upper end of the pin is positioned below the common mating plane allowing first housing member to rotate relative to the second housing member about the pivot axis.

2. The locking mechanism of claim 1 wherein the plurality of apertures in the second housing member comprise a pair of apertures formed in the proximal end of the housing member corresponding to a first and at least one second mounting positions, wherein each of the pair of apertures cooperates with the channel in the first housing member to form a passage therebetween.

3. The locking mechanism of claim 2 wherein the first and second housing members are aligned about a longitudinal axis in the first mounting position and the second housing member is aligned normal to the longitudinal axis in the second mounting position.

4. The locking mechanism of claim 1 wherein the second housing member comprises a handle section of an elongate housing having a first wall including a post formed on an inner periphery adjacent the proximal end and an opposing second wall having a post formed adjacent the proximal end adapted to receive and secure the post extending from the first opposing wall.

5. The locking mechanism of claim 1 wherein the first housing member comprises a drive section of an elongate housing having a first wall and an opposed second wall, wherein a hole is formed in each of the opposing first and second walls adjacent the proximal end to receive posts extending from the proximal end of the handle section to form a pivot joint between the first and second housing members of the portable electric tool.

6. The locking mechanism of claim 5 wherein the pivot joint includes a fastener extending through a channel formed through the pair of posts of the first housing member.

7. The locking mechanism of claim 1 wherein the posts extending between the opposed walls of the handle section further comprise a male extension member extending from one post into a female receiving area in the opposing post to provide an interlock to secure the opposed posts together.

8. The locking mechanism of claim 1 wherein the second housing member further comprises a cavity formed in the outer periphery of the second housing member above the plurality of apertures to receive the locking member.

9. A portable electric tool comprising:

an elongate housing having a first housing member including a channel formed adjacent a proximal end and a second housing member pivotally connected to the first housing member at a pivot axis, wherein the first and second housing members cooperate about a common plane perpendicular to the pivot axis, wherein the second housing member includes a plurality of apertures formed through a proximal end alignable with the channel in the first housing member to form a passage therebetween;

a power source disposed within the housing;

a motor electrically connected to the power source mounted within the housing;

a switch connected to the motor provided on an outer periphery of the housing;

a chuck assembly receiving a tool bit disposed at a distal end of the second housing member, the chuck assembly being operatively connected to the motor; and a locking mechanism for adjustably positioning the first housing member relative to the second housing member about the pivot axis between a first position and at least one second position, the locking mechanism including a spring disposed within the channel, a pin biased against the spring shiftable between a locked position and an unlocked position within the channel and a locking member disposed on the second housing member including at least one projection extending through one of the plurality of apertures to selectively position the pin in the passage relative to the common mating plane, wherein the locking member engages an upper end of pin to position the pin between the locked position wherein the pin extends through this common plane and cooperates with both the channel and aperture to lock the first housing member relative to the second housing member and the unlocked position wherein the upper end of the pin is positioned below the common mating plane allowing first housing member to rotate relative to the second housing member about the pivot axis.

10. The portable electric tool of claim 9 wherein the plurality of apertures in the second housing member comprise a pair of apertures formed in the proximal end of the housing member to create a first and at least one second mounting positions, wherein each of the pair of apertures cooperates with the channel in the first housing member to form a passage therebetween.

11. The portable electric tool of claim 10 wherein the first and second housing members are aligned about a longitudinal axis in the first mounting position and the second housing member is aligned normal to the longitudinal axis in the second mounting position.

12. The portable electric tool of claim 9 wherein the second housing member comprises a handle section of an elongate housing having a first wall including a pair of posts formed on an inner periphery adjacent the proximal distal end and an opposing second wall having a post formed adjacent the proximal end adapted to receive and secure the post of the first opposing wall.

13. The portable electric tool of claim 9 wherein the first housing member comprises a drive section of an elongate housing having a first wall and an opposed second wall wherein a hole is formed in each of the opposing first and second walls adjacent the proximal end to receive posts extending from the proximal end of the handle section to form a pivot joint between the first and second housing members of the portable electric tool.

14. The portable electric tool of claim 9 wherein the pivot joint includes a fastener extending through a channel formed through the pair of posts of the first housing member.

15. The portable electric tool claim 9 wherein the second housing member further comprises a cavity formed in the outer periphery of the second housing member above the plurality of apertures to receive the locking member.

16. The portable electric tool of claim 9 wherein the power source is disposed in an inner periphery of the handle section and the motor is disposed in ane inner periphery of the drive section to balance the weight distribution between each section of the housing.

17. The portable electric tool of claim 9 wherein the power source further comprises one or more rechargeable batteries releasably mounted in the inner periphery of the handle section adjacent a distal end.

18. The portable electric tool of claim 9 wherein each of the handle section and drive section are generally tubular in shape.

19. A portable electric screwdriver comprising:

an elongate housing having a handle section and a drive section pivotally connected to the handle section about a pivot axis;

a power source disposed within an inner periphery of the handle section;

a motor electrically connected to the power source mounted within an inner periphery of the drive section;

a switch connected to the motor disposed on an outer periphery of the housing;

a chuck assembly receiving a tool bit disposed at a distal end of the drive section, wherein the chuck assembly is operatively connected to the motor;

a passage formed through the elongate housing, the passage comprising a channel formed adjacent a proximal end of the handle section alignable with one of a plurality of apertures formed adjacent a proximal end of drive section; and a locking mechanism including a spring disposed within the passage, a pin biased against the spring shiftable between a locked position and an unlocked position and a locking member adapted to shift the pin between the locked and unlocked positions, wherein the locking member translates the pin between a locked position wherein an upper end of the pin extends through the common mating plane perpendicular to the pivot axis cooperating with the channel and one of the plurality of apertures and the unlocked position wherein the upper end of the pin is positioned below the mating plane to adjustably position the first housing member relative to the second housing member about the pivot axis.

* * * * *